United States Patent [19]

Yoshitomi et al.

[11] Patent Number: 4,764,448

[45] Date of Patent: Aug. 16, 1988

[54] AMORPHOUS SILICON HYDRIDE PHOTORECEPTORS FOR ELECTROPHOTOGRAPHY, PROCESS FOR THE PREPARATION THEREOF, AND METHOD OF USE

[75] Inventors: Toshihiko Yoshitomi, Yokohama; Hiromi Horiuchi, Tokyo; Yukio Yamaguchi, Kawasaki; Yasuo Kamoshita, Yokohama; Kiyoshi Sekihara, Tsukui, all of Japan

[73] Assignee: Mitsubishi Chemical Industries, Ltd., Tokyo, Japan

[21] Appl. No.: 847,409

[22] Filed: Apr. 2, 1986

[30] Foreign Application Priority Data

| | | | |
|---|---|---|---|
| Apr. 5, 1985 | [JP] | Japan | 60-72355 |
| Apr. 5, 1985 | [JP] | Japan | 60-72356 |
| Nov. 21, 1985 | [JP] | Japan | 60-261879 |
| Nov. 22, 1985 | [JP] | Japan | 60-263292 |
| Nov. 22, 1985 | [JP] | Japan | 60-263293 |
| Nov. 22, 1985 | [JP] | Japan | 60-263294 |
| Nov. 25, 1985 | [JP] | Japan | 60-264546 |
| Nov. 25, 1985 | [JP] | Japan | 60-264547 |

[51] Int. Cl.[4] ..... G03G 9/08; G03G 21/00

[52] U.S. Cl. ..... 430/120; 430/104; 430/110; 430/164; 430/127; 51/281 R; 51/307

[58] Field of Search ..... 430/104, 110, 120, 125, 430/127

[56] References Cited

U.S. PATENT DOCUMENTS

| | | | |
|---|---|---|---|
| 2,772,991 | 12/1956 | Insalalo | 430/125 X |
| 2,911,330 | 11/1959 | Clark | 430/125 X |
| 2,919,247 | 12/1959 | Allen | 430/110 |
| 3,592,675 | 7/1971 | Cheng | 430/104 X |
| 3,910,697 | 10/1975 | Lanker | 430/127 X |
| 3,983,045 | 9/1976 | Jugle et al. | 430/110 |
| 4,019,903 | 9/1977 | Hagenbach et al. | 430/104 |

FOREIGN PATENT DOCUMENTS

| | | | |
|---|---|---|---|
| 2917015 | 11/1979 | Fed. Rep. of Germany | 430/125 |
| 54-53538 | 4/1979 | Japan | 430/110 |
| 55-166652 | 12/1980 | Japan | 430/110 |
| 58-91462 | 5/1983 | Japan | 430/110 |
| 58-115464 | 7/1983 | Japan | 430/127 |

*Primary Examiner*—Roland E. Martin

*Attorney, Agent, or Firm*—Ernest V. Linek; David G. Conlin

[57] ABSTRACT

An amorphous silicon photoreceptor for electrophotography having a specific surface roughness is disclosed herein. Also provided are a process for the preparation and/or regeneration of the material and improved methods for electrophotography, which use a special abrasive. The material enables the electrophotography without occurance of any image blurring under high humidity conditions.

17 Claims, 2 Drawing Sheets

AMORPHOUS SILICON HYDRIDE PHOTORECEPTORS FOR ELECTROPHOTOGRAPHY, PROCESS FOR THE PREPARATION THEREOF, AND METHOD OF USE

BACKGROUND OF THE INVENTION

1. Field of the Invention

This invention relates to an amorphous silicon hydride photoreceptor for electrophotography which causes no "image blurring" (as defined hereinafter) in use under a high-humidity environment, a process for the preparation and/or regeneration thereof, and a method of electrophotography using such a photoreceptor.

2. Description of the Prior Art

Electrophotography is but one of several permanent image forming methods, the principle of which was discovered by Carlson in 1938. Various improvements have been made on the technique and now electrophotography is widely applied in the image recording arts, for example, in plain paper copiers (PPCs), laser printers, facsimiles" and the like: see R. M. Schaffert, "Electrophotography", 1975, Focal Press Ltd.

Generally, an electrophotographic method comprises several elementary processes. In PPCs, for example, the method usually comprises the following processes:

(1) Charging

Corona ions of a certain polarity (for example, the positive polarity) produced by a corona charger are accumulated on the surface of a photoreceptor in the dark. Since the photoreceptor is electrically an insulator having resistivity (p) above $10^{12}$ ohm-cm in the dark, the surface of the material is positively (or otherwise negatively) charged and the acceptance potential usually reaches about 400 V or higher.

(2) Exposure

Light (usually visible ray) is irradiated to an original so that an image of light reflected from the original is formed on the surface of the photoreceptor by means of an appropriate optical lens system. Since the irradiated part of the material becomes electrically conductive, the charge on this part is leaked away to the earth. Thus, an image of charge corresponding to the original image to be copied is produced on the surface of the photoreceptor. The image of charge is called an electrostatic latent image.

(3) Development

Development may be carried out by either the wet or dry process. In recent years the dry process has become more popular due in part to their being no need for any special solvent. The dry process is further divided into a dual-component system and a mono-component system. The dual-component developing system, there are used.

In the dual-component system, there are used resin particles containing a coloring material, namely toner, such as carbon black and magnetic particles, called a carrier. The toner and carrier are mechanically mixed so that they may be charged due to the triboelectric effect. The polarity of the charge may be controlled by the type and amount of a charge control agent, such as a dye and a pigment, in the toner. When the photoreceptor has a positively charged electrostatic latent image, a toner will have the opposite polarity; that is, a negatively charged toner is used.

The toner and carrier are distributed on the surface of a cylinder, called the "Magroll," which incorporates a magnet and is designed to leak out a magnetic flux. Thus, the carrier, which is a magnetic substance, and the electrostatically attracted toner are arranged along the magnetic flux on the Magroll surface, and a so-called "ear" is produced. Generally, the Magroll is rotated and the ear is contacted with the photoreceptor. The toner is attracted to the opposite, positive charges on the photoreceptor and moves from the carrier to the surface of the receptor material.

Consequently, a visible toner image corresponding to the electrostatic latent image is formed on the photoreceptor. This process is generally known as the magnetic brush development.

The toner which moves from the magnetic brush to the photoreceptor and is consumed in the developing process can be properly supplied in the course of the process, so that the mixing ratio of the toner and the carrier may be maintained at a constant value; usual weight ratios of the toner to the carrier are in the range of about 2% to 6%.

(4) Transferring

The visible toner image on the photoreceptor is then transferred onto plain paper. This is accomplished by placing the paper on the surface of the photoreceptor and applying corona discharge, which has a polarity (e.g., positive as in the above case) opposite to the toner charger polarity (e.g., negative as in the above case), to the paper from its back, i.e. the side opposite to the side thereof contacted with the photoreceptor. Thus, the toner is attracted and transferred from the photoreceptor to the paper surface.

After the transferring, the paper is fixed, whereas the photoreceptor is discharged, cleaned and charged again for repeated use in the foregoing process steps (1) to (4). The fixing, discharging and cleaning processes are carried out in the following manner.

(5) Fixing

The toner on the plain paper is heated above the softening point of a resin which is contained as a main component in the toner, so that a semipermanent visible image may be obtained. Generally, the paper and toner are pressed by heated rollers or passed over an electrical heater (e.g., an oven).

(6) Discharging

In this process, the electrostatic latent image on the surface of the photoreceptor is eliminated. Two methods are usually used. One is the photo-discharging method in which light is irradiated on the whole surface of the photoreceptor to remove the surface charge by the photoconductivity of the material. The other is the method in which an alternating electric field is applied to a corona discharger so that alternating charged particles (corona with either positive or negative polarity) may be alternatively charged to the surface of the photoreceptor, resulting in the neutralization of charges on the surface of the material. These two methods may be used alone or in combination.

(7) Cleaning

A part of the visible image toner still remains on the surface of the photoreceptor after the development, transfer and discharging processes. The remaining toner is eliminated from the photoreceptor in a cleaning process. Cleaning is generally carried out mechanically. In the rotating brush method, the toner on a photoreceptor is removed by a rotating brush made of a resin such as nylon. In the blade cleaning method, the toner is scraped off by contacting the edge of a blade made of silicone rubber or the like with the surface of a photoreceptor.

The cleaned photoreceptors may be again subjected to the foregoing processes (1) to (7). Such a photoreceptor is usually in the form of a drum and passed through said series of processes while rotating. A corona charger, an optical exposure system, a developing unit, a transfer charger, a corona discharger and a cleaning unit are disposed so as to surround the photoreceptor drum.

Photoreceptors which have hitherto been used for electrophotography include dispersions of fine CdS, ZnO or other powder coated with the binder of organic material, Se (selenium) photoreceptors containing As or Te coated by the vacuum evaporation method, organic photoconductor and trinitrofluorene, and others.

More recently, attention has been drawn to the semiconductive properties, especially photoconductivity, of amorphous silicon hydride (hereinafter referred to as "a-Si") in the form of a film made by the plasma chemical vapor deposition (P-CVD) from silane ($Si_nH_{2n+2}$) gas, and studies have been made on the use of a-Si as photoreceptors for electrophotography as well as on the applications to solar cells, photosensors, imaging tubes, and the like.

Photosensitive a-Si films are made from raw materials containing essentially of silane gas by plasma CVD, as mentioned above. Various proposals and improvements have been made on the items required as a photoreceptor, such as acceptance voltage, spectral sensitivity and photoreceptor life.

For example, addition of diborane, ammonia, oxygen, hydrocarbon, germane ($Ge_nH_{2n+2}$), fluorosilane, and the like, to the raw material silane gas, and improvement of layer structures on a conductive substrate have been attempted. The photoreceptors based on such improved silicon hydride will hereinafter be referred to as "a-Si photoreceptors".

The a-Si has the following excellent properties as compared with the aforementioned conventional photoreceptors:

(i) It is innoxious and causes no pollution problem;

(ii) It is thermally stable (its crystallization temperature is 400° C. or higher); that is, its thermal stability is markedly higher than those of Se (crystallization temperature; 60° C.), organic substance-based photoreceptors, OPCs, ZnO or CdS;

(iii) It shows higher photosensitivity, and the sensitivity is substantially constant over the wider range of visible light wave length; and (iv) It has high surface hardness (Vickers hardness of 1,500 or higher) and is tough against the surface damage such as scratching.

For making best use of such advantageous properties, attempts have been made to apply the a-Si photoreceptors to high-speed PPCs, laser printers, facsimiles, and the like, as high-performance photoreceptors for electrophotography. However, the following problems have been pointed out.

Since a-Si photoreceptors have such chemical and thermal stability and high surface hardness as mentioned above, they were at first expected to exhibit both stable performance in use as photoreceptors under various environmental conditions and to endure a very large number of copying procedures. It was acutally found, however, that a phenomenon could occur in which the copy image is blurred with electrophotographic copying procedures using such a-Si photoreceptors were carried out under high-humidity conditions, more specifically, under a relative humidity (RH) above about 70%, and furthermore, no image could be obtained at all under higher humidity conditions: this phenomenon is herein referred to as "image blurring".

This image blurring becomes more conspicuous as copying procedures are repeated. Usually, the image blurring occurs when the charging-exposure-development-transfer process is repeated several thousand times in an ordinary PPC (plain paper copier) under a high-humidity condition. However, the reversibility of this phenomenon has also been found: that is, a clear image can be obtained if copying is again conducted under a low humidity after the image blurring has occurred under high humidity.

It may be considered that such image blurring can be prevented by continuously heating an a-Si photoreceptor drum at a temperature of from about 40° to 50° C. so that the relative humidity around the drum surface may always be maintained below about 50%, even if the environmental humidity varies. In this case, however, an increased cost of the copying machine and its more complicated mechanism are unavoidable because of the incorporation of a heater into the drum and the provision of a temperature controller.

Thus, the image blurring is characterized by (1) the tendency to occur under high humidity, and (2) the tendency to be more conspicuous as copying procedures are repeated.

The cause of the image blurring has not yet been completely elucidated. Such image blurring will not be a serious problem for conventional photoreceptors, for example, those utilizing Se photoreceptors. In their efforts at overcoming this image blurring problem, the present inventors closely studied the above characteristics, especially the latter, and as a result of these studies, formulated the present invention.

The present inventors found in the course of their experiments the following two facts which appeared to give a solution to the image blurring.

(I) The primary cause of image blurring which become conspicuous with repeated copying procedures is the deterioration of the surface of photoreceptors due to corona charge. This fact was revealed in the course of the following experiments on each elementary process of electrophotography, i.e. corona charging, exposure, development or cleaning.

A commercially available copying machine was modified so that only one of the elementary processes, that is, (a) the initial corona charging and the alternative corona discharging, (b) the light irradiation, (c) the magnetic brush development, (d) the cleaning, might be conducted separately, and each operation was repeated as many times as the number of operating procedures corresponding to that required to take 10,000 copies. Thereafter, a copying test was carried out at 30° C., 80% RH (relative humidity) to examine the occurrence of image blurring. The phenomena most often occurred with a-Si photoreceptors which had been subjected to the repeated corona charge (a) alone.

On the other hand, a commercially available Se photoreceptor was treated in the same manner by the repeated corona charge alone at 30° C., 80% RH. Similar image blurring was observed.

Thus, although image blurring also occurs in conventional Se photoreceptors treated by corona charge alone, it may be supposed that the surface layer of the conventional materials, which have a relatively low surface hardness, is gradually scraped off in the course of the entire processes in PPC, in particular the development and cleaning processes and, therefore, a fresh surface condition may always be maintained.

On the contrary, a-Si photoreceptors have extremely high surface hardness. Accordingly, it may supposed that when a deteriorated surface layer is produced by corona charge, the deteriorated layer is not thoroughly removed even through the magnetic brush development and/or cleaning process, but rather such a layer will be accumulated as copying procedures are repeated.

This is apparently the reason why such image blurring, which is not significant with conventional photoreceptors, causes a serious problem in the electrophotography using a-Si material.

(II) As described in our copending Japanese Patent Application No. 228252/84, ESCA (Electron Spectroscopy for Chemical Analysis) of the outermost surface of an a-Si photoreceptor having been subjected to corona charge revealed that an oxide layer was formed to a depth of approximately 100 Angstroms from the surface layer. Thus, it is evident that such a surface layer has a degree of oxidation distinctly different from that of a surface which has not been subjected to corona charge.

The present inventors have discovered that the problem of image blurring in a-Si photoreceptors can be solved by either improving one or several processes in the electrophotographic operation or by adding an additional process to the conventional electrophotographic processes, whereby to effect gradual removal (i.e., polishing) of the surface of the a-Si photoreceptors.

In order to attain the solution there will be the following three means:

(A) Incorporation of a substance excellent in the polishing propery as an additive (external additive) to the developer;

(B) Addition of a process for polishing the a-Si surface, independent of the developing process; and (C) Improvement of a member for cleaning so as to attain the addition of the polishing effect (B).

Such means have already been proposed for use in conventional electrophotography and are in part disclosed in one or more conventional electrophotographic patents. For example, the use of common hard abrasive substances such as $CeO_2$, $BaTiO_3$, SiC and $Al_2O_3$ as an external additive for a developer has been attempted. It has also been proposed that a cleaning blade may be made of a material having a higher surface hardness than a-Si.

According to the investigations by the present inventors, however, it has been found that the conventional, hard abrasive polishing of the surface cannot give any satisfactory solution to the image blurring if removal of the deteriorated surface layer of a-Si materials is attempted. The present inventors have discovered that in order to obtain the desired polishing effect in a-Si photoreceptors, a novel abrasive, having a surface hardness lower than that of a-Si and being solid-phase reactive therewith, must be used.

SUMMARY OF THE PRESENT INVENTION

According to the present invention, there is provided an amorphous silicon hydride photoreceptor for electrophotography which has at least one of the following properties:

(i) the mean surface roughness along the center line as measured by a needle type surface roughness tester being 190 Angstroms or less;

(ii) the mean surface roughness along the center line as measured by a coordinates measuring scanning electron microscope and a section measuring apparatus being 60 Angstroms or less;

(iii) the variance of mean surface roughnesses along the center line as measured by a coordinates measuring scanning electron microscope and a section measuring apparatus being 70 Angstroms or less;

(iv) the maximum surface amplitude as measured by a coordinates measuring scanning electron microscope and a section measuring apparatus being 450 Angstroms or less; and (v) the difference between the mean of five largest values of the surface roughness as measured by a coordinates measuring scanning electron microscope and a section measuring apparatus and the mean of five smallest values of said surface roughness being 420 Angstroms or less.

There is also provided a process for preparing and/or regenerating an amorphous silicon photoreceptor for electrophotography, which is characterized by mechanically removing at least a part of a solid phase reaction product produced by using an abrasive substance capable of inducing a solid phase reaction with the photoreceptor for electrophotography into contact with the surface of said photoreceptor.

Further, there is provided an improved method for electrophotography which is characterized by using a developer containing at least one soft abrasive additive selected from carbonates and sulfates of alkaline earth metals, rare earth metals and transition metals, triiron tetraoxide, and mineral clays having a layer structure.

This invention also provides an improved method for electrophotography which is characterized by further comprising a step of polishing the surface of an a-Si photoreceptor on which an image is formed by using at least one soft abrasive substance selected from carbonates and sulfates of, alkaline earth metals, rare earth metals and transition metals; triiron tetraoxide; and mineral clays having a layer structure.

The invention further provides an improved method for electrophotography which is characterized by further comprising a step of contacting, preferably intermittently, an amorphous silicon photoreceptor with a cleaning member containing as a soft abrasive at least one substance selected from carbonates and sulfates of, alkaline earth metals, rare earth metals and transition metals; triiron tetraoxide; and mineral clays having a layer structure.

DETAILED DESCRIPTION OF THE PREFERRED EMBODIMENTS OF THE PRESENT INVENTION

Figure 1:
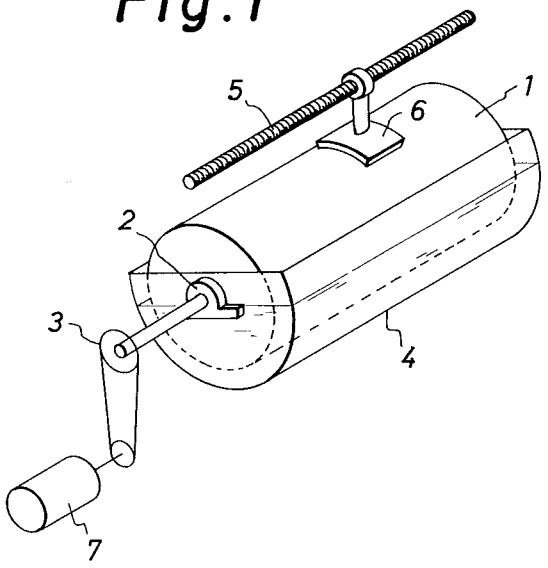
FIGS. 1 and 2 shown an example of the polishing apparatuses used in the invention, wherein a photoreceptor drum 1, a vessel 4 containing an abrasive, a cleaning roller 8, and a cleaning blade 9 are illustrated.

The present invention will hereinafter be described in more detail.

The surface of a conventional a-Si photoreceptor formed by plasma CVD usually has a fine unevenness due to the preparation process and the base Al tube. The present inventors measured surface roughness of many a-Si materials prepared by various processes by means of a needle type surface roughness tester entitled the "Talystep" manufactured by Rank Taylor Hobson Co., and found that the materials generally had the mean roughness along the center line of about 300 Angstroms with the minimum being about 210 Angstroms.

Further, the present inventors also measured the surface roughness by a coordinates measuring scanning electron microscope "EMM-3000" and a second measuring apparatus "PMS-1, both of Elionix Co., and calculated the mean roughness along the center line and others as defined hereinafter. Thus, the following surface characteristics of conventional a-Si photoreceptors were found:

(i) the mean roughness along the center line was generally around 110 Angstroms, with the minimum being about 85 Angstroms;

(ii) the variance of mean roughnesses along the center line was generally around 140 Angstroms, with the minimum being about 100 Angstroms;

(iii) the maximum amplitude was generally around 590 Angstroms, with the minimum being about 510 Angstroms; and (iv) the difference between the mean of five largest values and the mean of five smallest values was generally around 550 Angstroms, with the minimum being about 488 Angstroms.

Methods considered by the present inventors for lowering the surface roughness of a-Si photoreceptors include; (1) the surface of the photoreceptor is polished after the production thereof; (2) the processes and conditions for forming films are improved; and (3) the surface roughness of a base Al tube is reduced.

The inventors attempted to improve the surface roughness by the polishing method (1) described just above, and found that the image blurring under high humidity conditions can be prevented by polishing the surface of the a-Si photoreceptor immediately after the production thereof by means of an abrasive capable of causing a solid phase reaction with the material, as will be described below.

Thus, the surface of a-Si photoreceptors was polished longitudinally at a certain width (e.g., with a belt) for various periods of time according to the polished method (1) and photoreceptor drums having this polished part were subjected to a copying test. Image blurring occurred at the non-polished part after approximately 10,000 copies were formed, whereas at the polished part good image qualities were obtained with no image blurring under a high humidity even after 500,000 runs.

More detailed investigations of polishing conditions revealed that the effect of the polishing on the prevention of image blurring depended on the surface roughness of photoreceptors. Further, it was also found that the surface roughness of a polished photoreceptor could be controlled by the period of time for polishing if other polishing conditions such as pressure, and the like, were not varied; that is, the longer the polishing period is, the more reduced (the lower) the surface roughness is.

The present inventors have discovered as a result of further investigations that a marked advantage can be obtained when the surface of a photoreceptor has at least one of the following properties (i) to (v). The surface having at least the property (ii) is particularly preferred.

(i) The mean roughness along the center line as derived from measurements by a needle type surface roughness tester is 190 Angstroms or less, preferably 150 Angstroms or less, more preferably 120 Angstroms or less.

The mean roughness along the center line, R'(a), is defined by the following equation:

$$R'(a) = \frac{1}{L} \int_0^L |y'(x)|\,dx$$

where L is the length of the measured surface and y' (x) is any value of the measurements.

In the present invention the mean roughness along the center line is represented by the mean of ten values of R'(a) calculated by the above equation for the values measured at any ten positions on a photoreceptor. The measurement is carried out by a needle type surface roughness tester called the "Talystep" manufactured by Rank Taylor Hobson Co. under the following conditions—needle load: 4 mg, stylus: 0.1×2.5 microns, lateral magnification: 1,250 times, longitudinal magnification: 100,000 times, filter cut-off frequency: 0.33 Hz, measuring speed: 0.0025 mm/sec, and length to be measured: 30–80 microns.

(ii) The mean surface roughness along the center line as derived from measurements by a coordinates measuring scanning electron microscope and a section measuring apparatus is 60 Angstroms or less.

The mean roughness along the center line, R(a), is defined by the following equation (1):

$$R(a) = \frac{1}{L} \int_0^L |y'(x)|\,dx \qquad (1)$$

where L is the length of the measured surface and y(x) is any value derived from a measured value by eliminating low frequency components therefrom. In the invention, the "measured values" mean a set of data measured for 300 discrete data points within the measured length of 12 microns by a coordinates measuring scanning electron microscope "EMM-3000" and a section measuring apparatus "PMS-1", both having the magnification of 10,000 times and manufactured by Elionix Co.

Low frequency components are eliminated from the found values in the following manner.

A data set consisting of 2565 values, i.e. values measured at from the first data point to the 256th point of the 300 points, is taken. This corresponds to 10.24 microns of the measured length. These 256 values are expressed as $\{Y_j\}$, and the Fourier coefficients $\{a_k\}$ and $\{b_k\}$ defined by the following equations (2) are determined.

$$a_k = \frac{2}{n} \sum_{j=0}^{n-1} Y_j \cos \frac{2\pi kj}{n}, \; k = 0, 1, 2, \ldots, \frac{n}{2}, \qquad (2)$$

$$b_k = \frac{2}{n} \sum_{j=0}^{n-1} Y_j \sin \frac{2\pi kj}{n}, \; k = 01, 1, 2, \ldots, \frac{n}{2} - 1.$$

The Fourier coefficient $a_0$, $a_1$, $a_2$, $a_3$, $b_0$, $b_1$, $b_2$ and $b_3$, which correspond to low frequency components, are forced to zero. These components correspond to wave lengths infinity, 10.24, 5.12 and 3.41 microns, respectively. The thus modified Fourier coefficients are subjected to the Fourier inverse transformation defined by the following equation (3):

$$Y_j = \frac{1}{2} + \sum_{k=1}^{\frac{n}{2}-1} \left( a_k \cos \frac{2\pi kj}{n} + b_k \sin \frac{2\pi kj}{n} + \frac{1}{2} a_{n/2} \cos \pi j, \right. \quad (3)$$

$$j = 1, 2, 3, \ldots, n-1.$$

Thus, the data set from which the low frequency component is obtained has been excluded.

R(a) is calculated according to the above definitions. Taking into consideration possible random sampling, 10 sets of measured data are taken and the mean value of the sets is designated as the "mean roughness along the center line" in the present invention.

(iii) The variance of mean roughness along the center line as derived from measurements by a coordinates measuring scanning electron microscope and a section measuring apparatus is 70 Angstroms or less, preferably 50 Angstroms or less, more preferably 40 Angstroms or less.

The variance, $R_\sigma$, of mean roughness along the center line is defined by the following equation:

$$R_\sigma = \sqrt{\frac{\sum_{j=1}^{N} (Y_i - m)^2}{N}} \quad (1)$$

$$m = \frac{1}{N} \sum_{j=1}^{N} Y_i$$

wherein $Y_i$ represents any data value from a measured value by eliminating low frequency components, N is the number of data and m is the mean value of the data values from which the low frequency components have been eliminated.

The method for the measurement and the manner for obtaining the set of data by eliminating low frequency components from the measured data are the same as described for (ii) above. Thus, $R_\sigma$ is calculated from the measured data according to the definitions above. Taking into consideration possible random sampling, 10 sets of measured data are taken and the mean value of the sets is designated as the "variance of mean roughness along the center line" in the invention.

(iv) The maximum amplitude as derived from measurements by a coordinates measuring scanning electron microscope and a section measuring apparatus is 450 Angstroms or less, preferably 350 Angstroms or less, more preferably 250 Angstroms or less.

The maximum amplitude R(t) is defined as the largest peak-valley of actual data values from which the low frequency components have been eliminated.

The method for obtaining the measured data and the manner for deriving the set of data by eliminating low frequency components from the measured data are the same as described for (ii) above. Thus, R(t) is calculated from the measured data according to the above definitions. Taking into consideration possible random sampling, 10 sets of measured data are taken and the mean value of the sets is designed as the "maximum amplitude" in the invention.

(v) The difference between the mean of five largest values and the mean of five smallest values of the surface roughness as measured by a coordinates measuring scanning electron microscope and a section measuring apparatus is 420 Angstroms or less, preferably 300 Angstroms or less, more preferably 250 Angstroms or less.

The difference, $R_z$, between the mean value of five data from the maximum and the mean value of five data from the minimum is defined as the difference between the mean value of five largest data and the mean value of five smallest data, these data being those values obtained by eliminating low frequency components from the measured data.

The method for obtaining the measured data and the manner for deriving the set of data by eliminating low frequency components from the measured data are the same as described for (ii) above. Thus, $R_z$ is calculated from the measured data according to the above definitions. Taking into consideration possible random sampling, 10 sets of measured data are taken and the mean value of the sets is designated as the "difference between the mean value of five largest values and the mean value of five smallest values" in the invention.

The amorphous silicon hydride (a-Si) photoreceptors of the present invention can be obtained by contacting the surface of a conventional a-Si photoreceptor (i.e., one whose surface does not have any of the above described properties) with a soft abrasive selected from the group consisting of carbonates and sulfates of, alkaline earth metals, rare earth metals and transition metals; iron oxides, especially triiron tetraoxide ($Fe_3O_4$); and mineral clays having a layer structure, which can participate in a solid phase reaction with the surface material of the photoreceptor, and mechanically removing at least a part of the reaction product formed by the solid phase reaction of the surface material with the abrasive.

This process according to the invention can be applied not only to such a new photoreceptor immediately after being produced but also to the regeneration of a photoreceptor which has caused image blurring.

The substance, i.e. abrasive, capable of participating a solid phase reaction with the photoreceptor surface, which may be used in the invention is selected from the group consisting of carbonates and sulfates of, (a) alkaline earth metals such as Ba, Mg, Ca, and the like, (b) rare earth metals such as Ce, Y, La, Eu, and the like, and (c) other transition metals such as Fe, Ti, Zr, and the like; triiron tetraoxide, and mineral clays having a layer structure such as kaolinite, montmorillonite, and the like.

Carbonates of alkali earth metals or rare earth metals are especially preferred.

The substances can effectively prevent the image blurring in the electrophotography using a-Si photoreceptors by any of the methods which are mentioned above and will hereinafter be described in more detail.

The abrasives used in the invention are referred to herein as "soft abrasives" because they have a relatively low hardness when compared to conventional hard abrasives (e.g., $CeO_2$, $BaO_3$, SiC, $Al_2O_3$, and the like) and are unusual in that they have a hardness less than the substance being polished, a-Si. In this respect, the present process is quite distinct from conventional processes utilizing an abrasive with hardness higher than that of a material to be polished. It has not been elucidated why the above mentioned carbonates, and the like are particularly effective for the removal of the deteriorated layer on an a-Si photoreceptor.

Some embodiments of the process according to the invention will be described hereinbelow.

(a) The abrasive according to this invention may be utilized as an external additive for a developer.

Generally, the larger the amount of an abrasive used, the more effective the polishing is. However, the use of too large an amount of an abrasive, as part of a developer together with a toner, may directly affect the quality of the developed and transferred image on a paper and usually cause deterioration of image quality. According to the present invention, therefore, the weight ratio of the abrasive to the toner in the developer is suitably limited within the range of from about 0.01 to 5% by weight, preferably from about 0.05 to 0.5% by weight.

The abrasive is preferably used in the form of a powder. The abrasive of the present invention preferably has a particle size smaller than that of the toner used therewith, usually approximately 10 microns, in order that no deterioration of image quality might be caused, although the particle size of the abrasive which has a relatively low hardness, is gradually reduced by repeated operations such as mixing with a developer, contact with a photoreceptor, and the like.

The abrasive used as an external additive in the present invention may be supplied into a developer together with a toner after being mixed therewith, or it can be supplied alone into a developer.

(B) The abrasive according to this invention may be utilized in an additional process other than in the development process.

As stated above, the addition of an abrasive to a developer may be accompanied by the deterioration of image quality. In such a case, it is desirable to provide an independent process for polishing the surface of an a-Si photoreceptor. Further, such an additional process may be used together with the addition of an abrasive additive to the developer.

More specifically, such an additional process advantageously involves the use of a jig, or a like member, useful for contacting the abrasive according to this invention with the surface of the a-Si photoreceptor drum uniformly along the axial (longitudinal) direction, a means for supplying the abrasive to both the jig and the drum surface, and a means for preventing scattering of the abrasive in the copying machine. For example, a magnetic brush developing unit containing the abrasive (but no toner) may be provided independently of the developing process. In another construction, a blade-like jig is pressed on the surface of the a-Si photoreceptor by a spring or other means under an appropriate pressure of from about 10 to 1,000 g/cm$^2$, so that the abrasive of the present invention may be interposed between the jig and the photoreceptor.

This additional process may preferably be carried out after the transfer process but before the corona recharging process in electrophotography. More preferably, this process may be incorporated with the cleaning process which will be hereinafter described in detail, since a simpler construction of the whole apparatus can thus be attained.

An embodiment of this invention where a polishing machine is used to contact the surface of a photoreceptor with the abrasive will be described hereinbelow.

Any polishing machine which can polish the surface of a cylindrical drum may be used in the present invention. A machine in which the drum is continuously contacted with the abrasive while the surface thereof is polished by a pad as shown in FIG. 1 is preferably utilized.

In FIG. 1, a polishing machine is shown which comprises a photoreceptor drum 1, a bearing 2 for fixing the drum in position, a pulley 3 for transmitting the rotation from a motor to a shaft of the drum, a container 4 for retaining the abrasive at all times, a means 5 for holding a pad and moving it in the axial (longitudinal) direction of the photoreceptor drum at a constant speed, a jig 6 attached to the means 5 and fixing the pad for polishing the surface of the photoreceptor drum, and a speed-controllable motor 7.

The pad may be any of any type, but preferably it should be soft so as not to scratch the drum. Most preferably, it is a soft cloth or non-woven fabric. The shape of the pad to be contacted with the circular surface of the photoreceptor drum is preferably a circular arc concentric to the transversely sectional circle of the drum, said arc corresponding to a central angle of the circle of at least 10 degrees, in order to avoid any linear contact of the pad with the surface.

The size of the container 4 is preferably slightly larger than that of the photoreceptor drum. But too large a size is not preferred since the amount of the abrasive to be fed will increase largely. The container 4 may not always be necesssary in certain polishing conditions. For instance, if a pad fixed on the jug 6 is initially impregnated with an abrasive, the abrasive can be evenly and thinly distributed all over the photoreceptor surface by rotating the drum while moving the pad along the means 5.

The drum may usually be rotated at a speed of from about 10 to 200 r.p.m., but a speed of from about 20 to 50 r.p.m. is preferred. When the speed rotation is in the range of from about 20 to 50 r.p.m., a period of time for polishing is usually from about 5 to 30 minutes. If lower speeds of rotation are utilized, the polishing time will generally be prolonged.

The particle size of the soft abrasive of the present invention, unlike ordinary hard abrasives, may be as large as several tens microns (from about 10 to 30 microns) or even greater, but preferably the particle size of the abrasive is 30 microns or less. Because the abrasive is softer than the a-Si photoreceptor, the abrasive itself will be broken and its size will be reduced in the course of the polishing. For example, if a commercially available special grade $BaCO_3$ reagent is treated in a mortar to adjust its average particle size to approximately 30 microns and is then used in polishing at 25 r.p.m. for 10 minutes in the apparatus shown in FIG. 1, the final average particle size will be approximately 5 microns. The fracture section of the broken abrasive is chemically active and a solid phase reaction may readily occur under the high pressure of several Kbar exerted at the contact point between the abrasive and the surface of the photoreceptor. Thus, unlike when using ordinary hard abrasives, it is not necessary in the method of the present invention to strictly control the particle size distribution and the average particle diameter of the abrasive.

(C) Improvement of cleaning process:

The desired effect of the invention can also be achieved by using a cleaning member comprising the abrasive according to the invention as a constituent.

More specifically, the abrasive may be solidified and shaped into any form of members for use in the cleaning process, for example, a cleaning blade, a cleaning roll, a cleaning brush, and the like, by employing a suitable means, e.g., by using an appropriate binder (e.g., organic or other). Alternatively, the abrasive of this invention may be incorporated into a presently used cleaning blade or brush made of a resin.

The current compounding techniques in the plastics art may enable a person with ordinary skill to prepare a composite material having the content of the abrasive of about 30% by volume or more. Such a technique enables the preparation of a resinous cleaning blade, brush, roll, sponge or other member which contains the abrasive of this invention.

When such a cleaning member comprising the abrasive as a constituent is contacted with the a-Si photoreceptor drum, it is sufficient for the purpose of the present invention to contact the member with the drum intermittently, rather than constantly. For example, the ratio of the period of time for contacting the member with the drum to that for rotating the drum is selected from the range of 1:5 to 1:500, preferably 1:50 to 1:10.

In order to investigate the effect of such members on the prevention of image blurring, the surface of an a-Si photoreceptor which had exhibited an image blurring after numerous copying procedures was polished with a cleaning member containing $SmCO_3$ or $BaCO_3$ as the abrasive, and thereafter the photoreceptor was again subjected to copying procedures under a high humidity condition (85% RH, 30° C). It was found that the image blurring was effectively prevented at the polished part in contrast with non-treated parts, and that the preventive effect could last during 1,000 runs of copying. Further, when the surface polishing was conducted intermittently every 1,000 runs, the polished part could give a good image quality without any image blurring under a high humidity condition even after 80,000 runs. It was found that when a non-treated part where an image blurring had been exhibited in the course of 80,000 runs was polished with the above abrasive containing cleaning member, a good image quality could be obtained without any image blurring under a high humidity condition. This means that an a-Si photoreceptor which has caused any image blurring can be regenerated by polishing the photoreceptor with the abrasive of the present invention.

Consequently, it has been found that in an electrophotographic copying machine using the a-Si photoreceptor of the invention, any image blurring can be prevented from occurring by intermittently polishing the photoreceptor with the abrasive approximately eery 1,000 runs.

These cleaning members, such as cleaning blade, cleaning brush, cleaning roll, cleaning sponge, and the like, may be used in a conventional cleaning process, hereinafter referred to as the first cleaning process. However, it is more effective that an additional cleaning process, hereinafter referred to as the second cleaning process, is provided after the first cleaning process and the cleaning members comprising the soft abrasive of the present invention are used in this second process. In this case, any conventional cleaning member may be utilized in the first cleaning process. Thus, a sufficient polishing effect can be attained merely by intermittently contacting the photoreceptor drum with the cleaning member containing the abrasive of the present invention (for example, at a rate of several tens times of contact per several thousands runs of copying) in the second cleaning process. As compared with the constant contact, such an intermittently contacting method is more economically advantageous: that is, the present method enables an appreciable reduction of defects of the former method, such as deterioration due to toner contamination, wear, and the like, of the cleaning member, thus realizing a drastic prolongation of the life of the member.

The most simple method of effecting the intermittent contact of the cleaning member with the photoreceptor drum is one in which the member is manually contacted with and slid on the drum. Automatic intermittent contact methods using an electromagnetic or electric driving means include the cleaning blade method in which the blade and the pad are intermittently pressed on the drum, and the cleaning roller method.

The roller used in the cleaning roller method may be a foamed or unfoamed resinous rod-like member impregnated with the abrasive. Further, it is also effective to form grooves or the like on the rod.

Such a cleaning roller is contacted with the surface of the moving drum while being pressed thereon by an appropriate pressure of from about 1 g/cm$^2$ to 10 kg/cm$^2$. The contact of the drum and the cleaning member is preferably performed under friction, although the roller may be allowed to rotate freely. Thus, it is recommended to provide a suitable brake on the roller shaft so as to produce a difference between the circumferential speed of the roller and the circumferential speed of the moving drum. More preferably, the roller is rotated in the opposite direction to the rotating direction of the moving drum.

When the a-Si photoreceptors disclosed herein are employed, it will be possible to effect electrophotography without occurrence of any image blurring under high humidity conditions.

The present invention will be further illustrated with reference to the following examples which are intended to aid in the understanding of the invention but which are not to be construed as limitations thereof. All percentages reported herein, unless otherwise specified are percent by volume. All temperatures are expressed in degrees Celsius (°C.).

EXAMPLE 1

Two groups (A and B) of a-Si photoreceptor drums prepared under the same conditions were polished for various periods of polishing time. For each period of time used, the drum surface was polished by a width of about 5 cm.

The drums used were prepared in the following manner:

A cleaned cylindrical aluminum substrate of 120 mm in diameter and 340 mm in length having surface roughness of 0.1 S was placed in a reaction vessel. The substrate was baked under vacuum at or above 100° C. for 30 minutes. The vessel was evacuated by an oil diffusion pump for 30 minutes to a vacuum of $2\times10^{-5}$ Torr. Then, the pump was changed to an oil rotary pump and the reaction gases were introduced into the vessel.

The layer structure of the film formed and the conditions for the preparation thereof are as follows:

Photosensitive layer:
$NH_3/SiH_4=0.2\%$;
$B_{2H6}/SiH_4=40$ Vppm (ppm by volume);
Substrate temperature: 315° C.;
Period of time for forming a 25 micron film: 150 minutes;
Plasma power source: DC (direct current);
Plasma current density: 0.15 mA/cm$^2$,
Surface layer (a-$SiO_x$:H):
$N_2O/SiH_4=1.0$;
Period of time for forming about a 1000 Angstrom film; 5 minutes;
Plasma power source: AC 500 Hz;
Plasma current density: 40 microA/cm$^2$.

The abrasive used was barium carbonate. Each photoreceptor drum was set in the polishing apparatus shown in FIG. 1 and polished at a drum rotation speed of 20 r.p.m. while applying a load of 6 kg at the jig 6 in the figure.

The group A of drums was subjected to the polishing procedure for 50 to 120 minutes, whereas the group B of drums was polished for 60, 300 or 480 minutes.

After polishing, each drum was subjected to numerous copying procedures using a commercially available copying machine, "U-Bix 3300 MR" manufactured by KONISHIROKU PHOTO IND. CO., LTD., Japan, under normal humidity. Image blurring was checked every 10,000 runs of copying by subjecting the drum to copying procedures under high humidity conditions of 85% RH at 30° C. (One run herein means a series of procedures for obtaining one copy under normal humidity).

In the group A, an image blurring occurred at the non-polished part already after 10,000 runs of copying and began to occur at the 50 minute-polished part after 200,000 runs of copying. On the other hand, the 120 minute-polished part gave a good image quality without causing any image blurring even after 500,000 runs of copying.

In the group B, image blurring occurred at the non-polished part after 10,000 runs and began to occur at the 60 minute-polished part after 240,000 runs, while the 300 and 480 minute-polished parts gave a good image quality without causing any image blurring even after 1,000,000 runs.

A specimen of the non-polished or polished part of each drum was taken and the surface roughness of each specimen was measured by the aforementioned method using the "Talystep". The results are shown in Table I.

TABLE I

| | Polishing time (min) | R'(a) (Angstroms) | Remarks |
|---|---|---|---|
| Group A | 0 | 317 | Image blurring occurred after 10,000 runs of copying. |
| | 50 | 174 | Image blurring occurred after 200,000 runs of copying. |
| | 120 | 120 | No image blurring occurred after 500,000 runs of copying. |
| Group B | 0 | 275 | Image blurring occurred after 10,000 runs of copying. |
| | 60 | 161 | Image blurring occurred after 240,000 runs of copying. |
| | 300 | 113 | No image blurring occurred after 1,000,000 or more runs of copying. |
| | 480 | 92 | No image blurring occurred after 1,000,000 or more runs of copying. |

EXAMPLE 2

A specimen of the non-polished or polished part of each drum of Example 1 was taken and the surface roughness of each specimen was measured by the coordinates measuring scanning electron microscope "EMM-3000" and the section measuring apparatus "PMS-1". R(a), R, R(t) and $R_z$ calculated from the measured data in the aforementioned manner are shown in Table II.

TABLE II

| | Polishing (min) | R(a) (A) | R( ) (A) | R(t) (A) | $R_z$ (A) | Remarks |
|---|---|---|---|---|---|---|
| Group A | 0 | 89 | 108 | 531 | 488 | Image blurring after 10,000 |
| | 50 | 44 | 56 | 448 | 419 | Image blurring after 200,000 |
| | 120 | 35 | 46 | 266 | 247 | No image blurring after 500,000 or more |
| Group B | 0 | 96 | 120 | 537 | 516 | Image blurring after 10,000 |
| | 60 | 54 | 65 | 275 | 259 | Image blurring after 240,000 |
| | 300 | 30 | 42 | 265 | 238 | No image blurring after 1,000,000 or more |
| | 480 | 12 | 16 | 155 | 148 | No image blurring after 1,000,000 or more |

(A) = Angstroms.

EXAMPLE 3

Several a-Si photoreceptor drums prepared under the following conditions were polished while varying the period of polishing time and the abrasive. For each period of time and abrasive used, the drum surface was polished to a width of about 5 cm.

The drums were prepared in the following manner:

A cleaned cylindrical aluminum substrate of 120 mm in diameter and 340 mm in length having a surface roughness of 0.2 S was placed in a reaction vessel. The substrate was baked under vacuum at or above 100° C. for 30 minutes to a vacuum of $2\times10^{-5}$ Torr. The pump was changed by an oil rotary pump and the reaction gases were introduced into the vessel to prepare a film having the following layer structure:

Photosensitive layer:
$NH_3/SiH_4=0.2\%$
$B_2H_6/SiH_4=40$ Vppm;
Substrate temperature: 315° C.;
Period of time for forming a 25 micron film: 150 minutes;
Plasma power source: DC;
Plasma current density: 0.15 mA/cm$^2$,
Surface layer (A-$SiO_x$:H):
$N_2/SiH_4=1.0$;
Period of time for forming about a 1000 Angstrom film: 5 minutes;
Plasma power source: AC 500 Hz;
Plasma current density: 40 microA/cm$^2$.

The abrasives used were barium carbonate, calcium carbonate, triiron tetraoxide, a polyester abrasive paper "Surfin 000" manufactured by Fujimi Kenmazal K.K., Japan, silicon carbide, and zirconium oxide.

Each photoreceptor drum was set in the polishing apparatus shown in FIG. 1 and polished with each abrasive at a drum rotation speed of 20 r.p.m. for 5 to 10 minutes.

After polishing, each drum was subjected to numerous copying procedures using a commercially available copying machine, U-Bix V2, KONISHIROKU PHOTO IND. CO., LTD., Japan, under normal humidity. Image blurring was checked every 5,000 runs of copying by subjecting the drum to copying procedures by subjecting the drum to copying procedures under the high humidity condition of 85% RH at 30° C.

The part treated with barium carbonate, calcium carbonate or triiron tetraoxide for 10 minutes gave a clear image without causing any image blurring even after 30,000 runs of copying. The part treated with each of said soft abrasives for only 5 minutes exhibited a slight image blurring after 30,000 runs. At the part non-treated or treated with "Surfin 000", silicon carbide or zirconium oxide, image blurring began to occur after 5,000 runs and extensively occurred after 10,000 runs of copying.

EXAMPLE 4

An a-Si photoreceptor drum similar to those used in Example 3 was set in a copying machine and subjected to 10,000 runs of copying procedures under normal humidity conditions. After having observed that image blurring certainly occurred under a high humidity condition of 85% RH at 30° C., the photoreceptor drum was placed in the polishing apparatus shown in FIG. 1 and a part of the drum surface of about 5 cm in width was polished with barium carbonate, silicon carbide, zirconium oxide or triiron tetraoxide at a drum rotation speed of 30 r.p.m. for 5 minutes.

Immediately after the polishing, only the part treated with barium carbonate or triiron tetraoxide could give the originally good image quality (i.e., that which the drum gave initially) with no occurrence of image blurring under the high humidity conditions of 85% RH at 30° C. All other abrasives were not effective and image blurring was observed in all drums treated with such abrasives.

The drum having the part treated with barium carbonate or triiron tetraoxide was then subjected to further 10,000 runs of copying procedures. Good image qualities could be obtained without causing any image blurring under high humidity conditions.

EXAMPLE 5

An a-Si photoreceptor drum was prepared in the following manner:

A cleaned cylindrical aluminum substrate of 120 mm in diameter and 340 mm in length was placed in a reaction vessel. The substrate was baked under vacuum at or above 100° C. for 30 minutes. The vessel was evacuated by an oil diffusion pump for 30 minutes to a vacuum of $2\times10^{-5}$ Torr. The pump was changed to an oil rotary pump and the reaction gases were introduced into the vessel. A film having the following layer structure was prepared.

Photosensitive layer:
$NH_3/SiH_4=0.2\%$
$B_2H_6/SiH_4-40$ Vppm;
Substrate temperature: 315° C.;
Period of time for forming a 25 micron film: 150 minutes;
Plasma power source: DC;
Plasma current density: 0.15 mA/cm$^2$,
Surface layer (a-$SiO_x$:H):
$N_2O/SiH_4-1.0$;
Period of time for forming about a 1000 Angstrom film: 5 minutes;
Plasma power source: AC 500 Hz:
Plasma current density: 40 microA/cm$^2$.

The developer used was composed of 970 g of iron powder having a particle size in the range of 10 to 200 microns as a carrier, 30 g of a conventionally used negatively charged toner, and 60 mg of abrasive chosen from barium carbonate, calcium carbonate, yttrium carbonate, magnesium carbonate, triiron tetraoxide, cerium carbonate, silicon carbide, silica, cerium oxide, or aluminum oxide, as an external additive.

The drum was subjected to numerous copying procedures under normal humidity using each of the ten types of developers and UBIOX V-II, KONISHIROKU PHOTO IND. CO., LTD., Japan. Image blurring was checked every 5,000 runs of copying by subjecting the drum to copying procedures under the high humidity condition of 85% RH at 30° C.

When barium carbonate, calcium carbonate, yttrium carbonate, magnesium carbonate, cerium carbonate, or triiron tetraoxide were used as the external additive, no image blurring was observed under a high humidity condition of 85% RH at 30° C. even after 30,000 runs of normal humidity copying procedures. On the other hand, when silicon carbide, silica, cerium oxide, or aluminum oxide was used as an external additive, image blurring began to occur under the high humidity condition of 85% RH at 30° C. at the end of 5,000 runs of normal humidity copying and extensively occurred after 10,000 runs.

When a developer free of external additive was used, an image blurring began to occur under a high humidity condition (85% RH, 30° C.) after about 5,000 runs of normal humidity copying and extensively occurred after 10,000 runs of copying.

EXAMPLE 6

An a-Si photoreceptor drum similar to those used in Example 5 was used for the following experiments.

Nine types of 10 cm wide non-woven fabrics were provided. Each fabric was impregnated with an abrasive selected from barium carbonate, calcium carbonate, triiron tetraoxide, lanthanum carbonate, cerium carbonate, silicon carbide, cerium oxide, aluminum oxide or diamond powder, respectively.

Each of the non-woven fabrics was fixed by a jig just behind the cleaning blade. A copying life test under normal humidity was carried out on the drum using a copying machine "UBIX V-II", KONISHIROKU PHOTO INC. CO., LTD., Japan and, every 5,000 runs of the copying procedures under normal conditions, image blurring was checked by subjecting the drum to copying procedures under the high humidity condition (30° C., 85% RH).

No image blurring was exhibited at 30°, 85% RH even after about 30,000 runs of normal humidity copying procedures when the drum was polished with barium carbonate, calcium carbonate, triiron tetraoxide, lanthanum carbonate, or cerium carbonate containing non-woven fabric. When the non-woven fabric containing silicon carbide, cerium oxide, aluminum oxide or diamond powder, or the abrasive-free non-woven fabric was used, image blurring began to be observed after 5,000 runs and was extensively caused under a high humidity condition of 85% RH at 30° C. after 10,000 runs of normal humidity copying procedures.

EXAMPLE 7

An a-Si photoreceptor drum was prepared under the following conditions:

A cleaned cylindrical aluminum substrate of 120 mm is diameter and 340 mm in length was set in a reaction vessel. The substrate was baked under vacuum at or above 100° C. for 30 minutes. The vessel was evacuated by an oil diffusion pump for 30 minutes to a vacuum of $2\times10^{-5}$ Torr. The pump was replaced by an oil rotary pump and the reaction gases were introduced into the vessel. A film was prepared under the following conditions:

Photosensitive layer:
$NH_3/SiH_4=0.2\%$
$B_2H_6/SiH_4-40$ Vppm;
Substrate temperature: 315° C.;
Period of time for forming 25 micron film: 150 minutes;
Plasma power source: DC;
Plasma current density: 0.15 mA/cm$^2$,
Surface layer (a-$SiO_x$:H):
$N_2O/SiH_4-1.0$;
Period of time for forming about a 1000
Angstrom film: 5 minutes;
Plasma power source: AC 500 Hz:
Plasma current density: 40 microA/cm$^2$.

The developer used was composed of 970 g of amorphous iron powder having a particle size in the range of 10 to 200 microns as a carrier and 30 g of a conventionally used negatively charged toner.

The drum was subjected to numerous normal humidity copying procedures using the developer and "UBIX 3300 MR", KONISHIROKI PHOTO IND. CO., LTD., Japan, and image blurring was then checked by subjecting the drum to copying procedures under 85% RH humidity at 30° C.

The following experiments were carried out in order to investigate the preventive effect of a cleaning member on image blurring.

A cleaning member was prepared by impregnating a foamed sponge of urethane elastomer with a mixture of SiC, $Al_2O_3$, $SmCO_3$ or $BaCO_3$ and a binder. The same sponge containing no polishing powder was used as a blank. The surface of the a-Si photoreceptor drum which had observed image blurring after 10,000 runs of normal humidity copying procedures was partially polished ten times lightly with hand by using each of the sponges. The thus polished drum was subjected to copying procedures under a high humidity condition to investigate image blurring.

The part of the drum treated with the blank, or the sponge containing SiC or $Al_2O_3$ caused image blurring, while the sponge containing $SmCO_3$ or $BaCO_3$ gave a good preventive effect on image blurring (the image quality was completely recovered by $BaCO_3$).

Further copying life tests showed that the prevntive effect could last about 1,000 copying procedures under a high humidity condition by $BaCO_3$ and about hundreds procedures of copying by $SmCO_3$.

Furthermore, the same part of the drum was polished with hand by $BaCO_3$ evey 1,000 copying procedures. A good image quality without image blurring could be obtained even after 80,000 copying procedures under a high humidity condition.

EXAMPLE 8

The following experiments were carried out using a-Si photoreceptor drums similar to those used in Example 7 in order to investigate the preventive effect of a cleaning member on image blurring.

A cleaning roller was prepared by impregnating a foamed urethane elastomer rod in the form of a roller with SiC, $Al_2O_3$, $SmCO_3$ or $BaCO_3$ powder mixed with a binder. The same rod containing no abrasive was used as a blank cleaning roller. The surface of the a-Si photoreceptor drum which had exhibited image blurring after 10,000 runs of copying procedures was contacted with the cleaning roller and rotated about 50 times. The drum was then subjected to copying procedures under a high humidity condition to investigate image blurring.

Image blurring was observed at the part of the drum polished with the blank, or the roller container SiC or $Al_2O_3$. A good preventive effect on image blurring was obtained by $SmCO_3$ or BaCO3 and $BaCO_3$ gave a complete recovery of the effect. Further copying life tests showed that the preventive effect on image blurring could last about 1,000 copying procedures by $BaCO_3$ and about hundreds copying procedures by $SmCO_3$.

Figure 2:
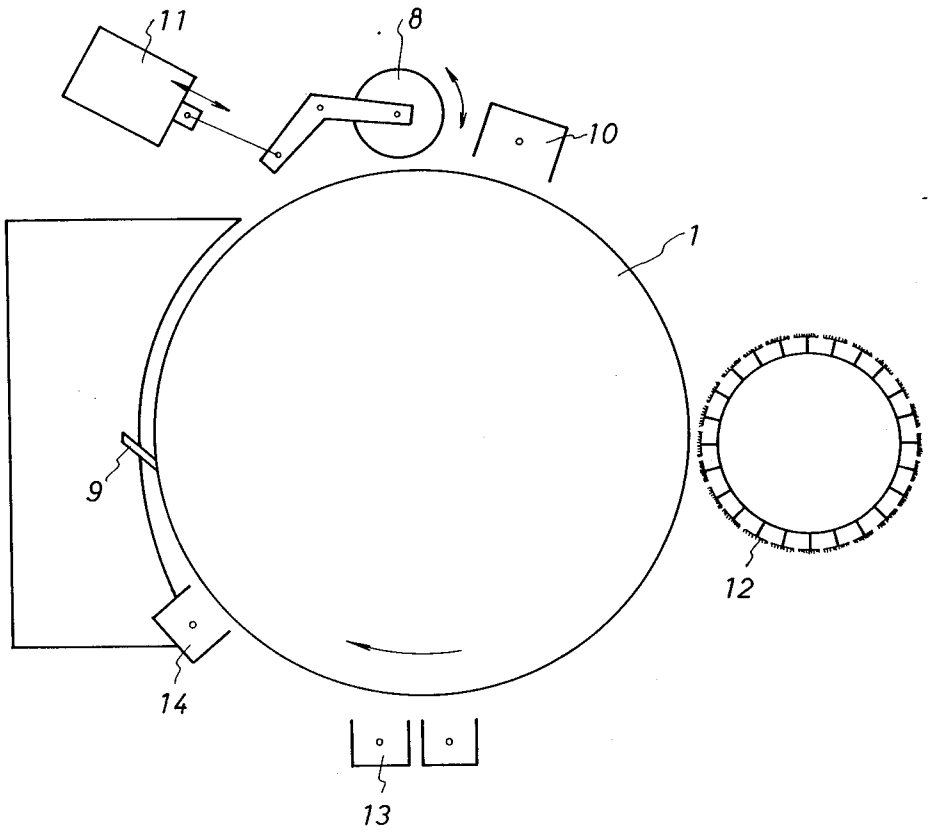

Considering these results, the cleaning roller impregnated with $BaCO_3$ was set in a copying machine, "UBIX 3300 MR", KONISHIROKU PHOTO IND. CO., LTD., Japan. As shown in FIG. 2, the cleaning roller 8 was placed between a cleaner blade 9 and a corona charger 10. In the figure, a magnetic brush (magroll) 12, a transfer charger 13 and a discharge unit 14 are also shown. The roller 8 was pushed on the photoreceptor drum 1 intermittently (50 rotations of the roller per 1,000 copying procedures) by using a solenoid coil 11.

Consequently, a good image without image blurring could be obtained even after 1,000,000 copying procedures under a high humidity condition. The cleaning roller was only slightly soiled and could be reused in further copying procedures.

The present invention has been described in detail, including the preferred embodiments thereof. However, it will be appreciated that those skilled in the art, upon consideration of the present disclosure, may make modifications and/or improvements on this invention and still be within the scope and spirit of this invention as set forth in the following claims.

What is claimed is:

1. A process for preparing and/or regenerating an amorphous silicon hydride photoreceptor for electrophotography, comprising mechanically removing the surface of the photoreceptor with an abrasive selected from the group consisting of carbonates and sulfates of, alkaline earth metals, rare earth metals and transition metals, said abrasive having a hardness which is lower than the hardness of the amorphous silicon hydride.

2. A process for preparing and/or regenerating an amorphous silicon hydride photoreceptor useful in electrophotography, comprising removing at least a part of a solid phase reaction product produced by contacting the photoreceptor with a soft abrasive substance selected from the group consisting of carbonates and sulfates of, alkaline earth metals, rare earth metals and transition metals, said abrasive having a hardness which is lower than the hardness of the amorphous silicon hydride.

3. The process of claim 2, wherein removal of the solid phase reaction product is accomplished by mechanical means.

4. The process of claim 3, wherein the mechanical means comprises a magnetic brush developing unit containing the abrasive.

5. The process of claim 3, wherein the mechanical means comprises a blade-like jig.

6. The process of claim 3, wherein the mechanical means comprises a solid cleaning member having the abrasive as a component thereof.

7. The process of claim 6, wherein the cleaning member is selected from the group consisting of blades, rolls, brushes, sponges or pads.

8. The process of claim 2, wherein the soft abrasive substance is in an admixture comprising developer suitable for use in electrophotography.

9. The process of claim 4, wherein the admixture further comprises toner suitable for use in electrophotography.

10. The process of claim 2, 4, or 5, wherein the soft abrasive substance is selected from the group consisting of the carbonates of, alkaline earth metals and rare earth metals.

11. In the method of electrophotography utilizing amorphous silicon hydride photoreceptors, the improvement comprising using a developer containing at least one soft abrasive additive selected from the group consisting of carbonates and sulfates of, alkaline earth metals, rare earth metals and transition metals, said abrasive having a hardness having a hardness which is lower than the hardness of the amorphous silicon hydride.

12. The method of claim 11, wherein the soft abrasive additive is selected from the group consisting of the carbonates of, alkaline earth metals and rare earth metals.

13. In the method of electrophotography utilizing amorphous silicon hydride photoreceptors, the improvement comprising adding a step for polishing the surface of the photoreceptor on which the image is formed by using at least one soft abrasive substance selected from the group consisting of carbonates and sulfates of, alkaline earth metals, rare earth metals and transition metals, said abrasive having a hardness hardness which is lower than the hardness of the amorphous silicon hydride.

14. The method of claim 13, wherein the polishing step is conducted as part of the cleaning sequence of the electrophotography.

15. The method of claim 14, wherein the cleaning sequence of the electrophotography comprises two steps;

a first cleaning process which includes the soft abrasive; and a second cleaning process which includes the soft abrasive.

16. The method of claim 15, wherein the second cleaning process occurs intermittently.

17. The method of claim 13, 14, 15, or 16, wherein the soft abrasive substance is selected from the group consisting of the carbonates of, alkaline earth metals and rare earth metals.

* * * * *